US005096389A

United States Patent [19]

Grady

[11] Patent Number: 5,096,389

[45] Date of Patent: Mar. 17, 1992

[54] COMPRESSED AIR FOAM DISCHARGING APPARATUS

[75] Inventor: Clarence A. Grady, Newport, Oreg.

[73] Assignee: Dean Pihlstrom, Inc., Siletz, Oreg.

[21] Appl. No.: 732,940

[22] Filed: Jul. 19, 1991

Related U.S. Application Data

[63] Continuation of Ser. No. 539,607, Jun. 18, 1990, abandoned.

[51] Int. Cl.[5] ..... F04B 35/06

[52] U.S. Cl. ..... 417/364; 417/201; 417/199.1; 169/14

[58] Field of Search ..... 417/364, 362, 201, 199, 417/234; 169/14, 15, 44; 418/DIG. 1

[56] References Cited

U.S. PATENT DOCUMENTS 2,135,721 11/1938 Landenberger ..... 417/362
2,198,585 4/1940 Urguhart et al. ..... 169/15
2,361,146 10/1944 Montelius ..... 418/DIG. 1
3,150,594 9/1964 Coberly et al. ..... 417/364
4,279,578 7/1981 Kim et al. ..... 418/DIG. 1
4,743,430 5/1988 Spielholz ..... 417/364
4,786,239 11/1988 Eberhardt ..... 417/364
4,974,556 12/1990 Royce ..... 123/559.1

*Primary Examiner*—Richard A. Bertsch
*Assistant Examiner*—Charles G. Freay
*Attorney, Agent, or Firm*—Kolisch, Hartwell, Dickinson, McCormack & Heuser

[57] ABSTRACT

The invented foam discharging apparatus includes an engine that uses a drive shaft to drive two fluid pumps. One of the two fluid pumps is directly engaged by the drive shaft. In the preferred embodiment of the invention, one of the fluid pumps is a centrifugal fluid pump that pumps water from a reservoir. The other fluid pump is a rotary screw air compressor.

6 Claims, 1 Drawing Sheet

COMPRESSED AIR FOAM DISCHARGING APPARATUS

This application is a continuation of application Ser. No. 07/539,607 filed June 18, 1990, to be abandoned.

TECHNICAL FIELD

This invention relates to an apparatus that discharges foam. More particularly, this invention concerns an apparatus that uses a single engine to drive two fluid pumps. The pumps combine chemically treated water with a volume of compressed air to form foam. The foam is used to extinguish fires and to clean and contain hazardous material spills.

BACKGROUND ART

Water firestreams are often used in battling fires. Water is similarly used in cleaning up and containing hazardous material spills. Although effective to a degree, several problems have consistently plagued water firestream users.

One problem relates directly to the weight of the water. When using water firestreams, it is often impossible to spray the water onto the fire or spill from a safe distance. The basis of this problem can be traced to limitations on the distance a water firestream can travel. Engines capable of driving water firestreams with necessary force are often cost and size prohibitive.

Hose lines containing water may also lead to problems. Full hoses are heavy and to advance them requires more work by fire fighting personnel.

Another problem associated with the use of water firestreams involves the immediate runoff or rapid evaporation associated with water. Water must be continually sprayed to put out the fire. Water firestreams are also ineffective in penetrating waxy and oily fuels often found at the sight of the fire.

Based on the aforementioned problems, developers of fire fighting systems recognize the advantages of foam discharging systems over water discharging systems. Foam systems combine water, air and detergent to form a bubble-structured product. However, it is difficult to combine the water and detergent with the air.

Aspirated foam systems combine air and water by passing the water through an aspirating nozzle. Aspirated foam systems, however, are plagued with low water velocity as the water exits the nozzle because of the power lost in combining the air and water solution.

Fire fighting systems must also be durable enough to withstand adverse conditions, while remaining compact enough for ready transportation to the fire. The present invention meets these requirements and overcomes the problems of the previously mentioned systems.

DISCLOSURE OF THE INVENTION

The invented foam discharging apparatus includes an engine that uses a drive shaft to drive two fluid pumps. One of the two fluid pumps is directly engaged by the drive shaft. In the preferred embodiment of the invention, one of the fluid pumps is a centrifugal fluid pump that pumps water from a reservoir. The other fluid pump is a rotary screw air compressor. The invented apparatus is compact, allowing for mobility, and the absence of a complicated gear or belt train allows for ease of maintenance.

DETAILED DESCRIPTION AND THE BEST MODE FOR CARRYING OUT THE INVENTION

Figure 1:
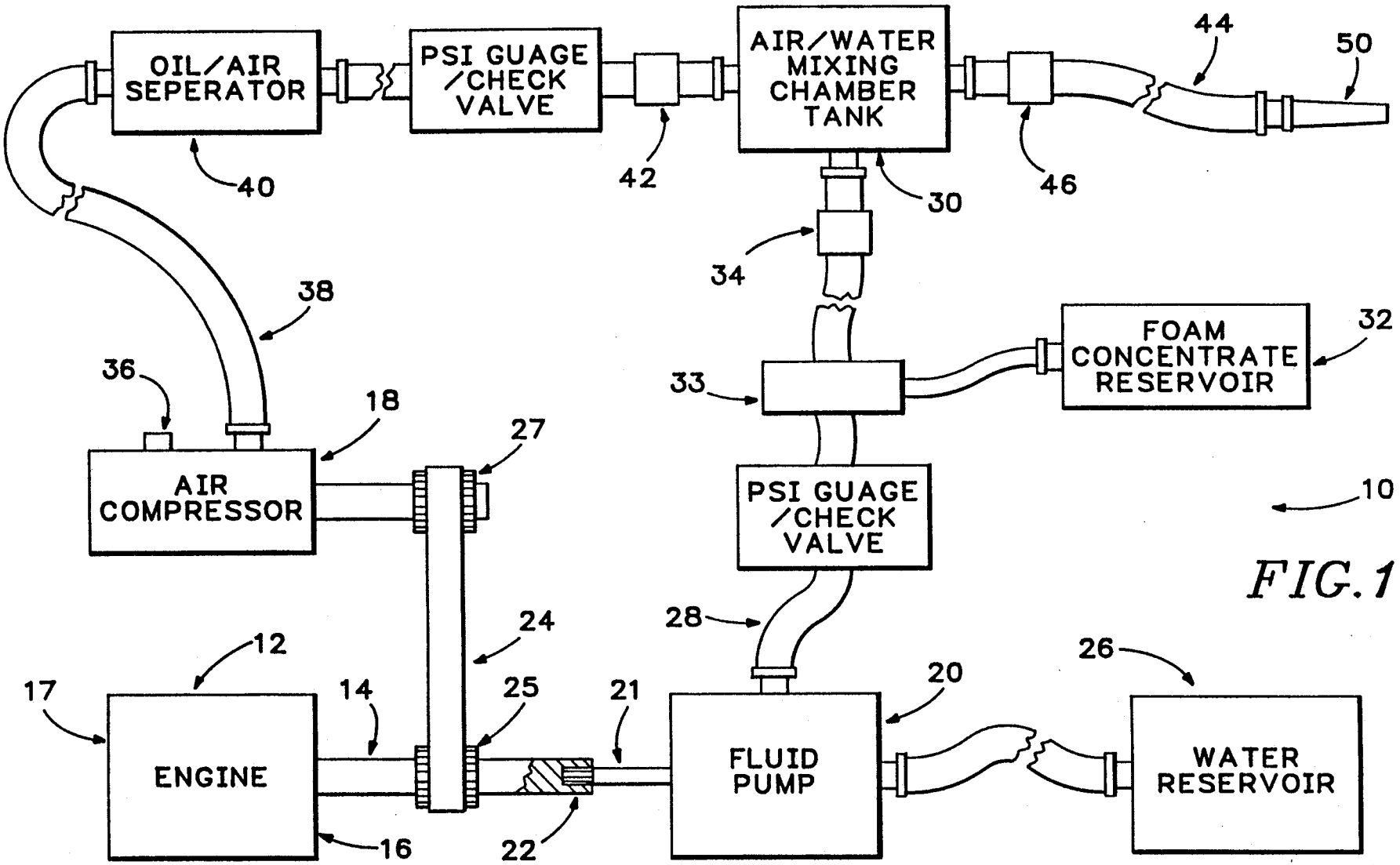
FIG. 1 is a simplified view of the preferred embodiment of the invention, showing an engine having a drive shaft that drives and directly engages a fluid pump and that also drives an air compressor.

Referring to FIG. 1, a preferred embodiment of the foam discharging apparatus is shown generally at 10. Apparatus 10 includes an engine 12 having a drive shaft 14. The engine may vary in both size and power capacity according to individual system needs.

Engine 12 includes a first end 16 and at least a portion of drive shaft 14 extends beyond the first end. The drive shaft may include a crankshaft connected to a flywheel, which in turn is connected to a stub shaft.

Engine 12 is used to drive a fluid pump 20 having an intake for receiving fluid and an exhaust for ejecting fluid. The fluid pump includes an input shaft 21 that is aligned with and directly engages drive shaft 14 by a splined connector joint shown generally by partial break-away at 22. Alternatively, a spline coupler or any other known means of joining the two shafts may be used. "Directly engaging" means that the engine's drive shaft drives a fluid pump by contacting the fluid pump without interceding gears or belts. The use of a clutch, however, is included within the meaning of "directly engaging."

Fluid pump 20 is also referred to as a means for pumping fluid. In practice, it is often a centrifugal fluid pump such as those available from the company W. S. Darley. Centrifugal fluid pumps are dynamic and supply a continuous high pressure output necessary for hose or cannon discharge when battling fires.

Engine 12 also drives an air compressor 18, which is alternatively referred to as a fluid pump. In the preferred embodiment, compressor 18 is a rotary lobe screw air compressor such as the Bauer Model B100. Rotary screw air compressors are compact and relatively quite as compared to piston and vane type air compressors.

Air compressor 18 communicates mechanically with drive shaft 14 through a belt 24. In the preferred embodiment the belt is toothed and extends around a toothed pulley 25 on drive shaft 14 and also around a toothed pulley 27 attached to the air compressor. The belt and pulleys may also be referred to as belt means. Different sized pulleys may be used to obtain the power ratio needed to drive the air compressor. Air compressor 18 could alternatively communicate mechanically with drive shaft 14 through a chain and sprocket, which may be referred to as chain means.

In another embodiment of the invention, a shaft may extend from both a first end 16 and a second end 17 the of engine. Air compressor 18 could then be driven by the shaft extending from the engine's second end.

Engine 12 is used to drive both pump 20 and compressor 18. Alternatively, air compressor 18 and pump 20 may be interchanged so that the air compressor is driven by a direct engagement with drive shaft 14. The direct engagement of the engine's drive shaft with a fluid pump eliminates the necessity of a complex gear or belt system. It also allows for a cost-effective and compact foam discharging apparatus.

Air compressor 18 takes air directly from the atmosphere through an intake port 36 and drives it out an exhaust and through an output air hose 38 to an air/water mixing chamber tank 30. Hose 38 includes upstream and downstream ends with its upstream end connected to compressor 18 and its downstream end connected to tank 30. Instead of a hose, a pipe or any other fluid output channeling means may be used to direct air into tank 30. The air enters tanks 30 through a regulatory valve 42.

An oil/air separator 40 is interposed between compressor 18 and tank 30 and connected to hose 38 when air compressor 18 is oil lubricated. Any known separator may be used, such as the separator that comes with the Bauer Model B100 compressor.

Fluid pump 20 directly is supplied with a fluid such as water from a water reservoir 26. In some cases, pump 20 draws water from a lake or another body of water. In the preferred embodiment, water is pumped by fluid pump 20 through an output water hose 28 to air/water mixing chamber tank 30. Hose 28 includes upstream and downstream ends, connected to fluid pump 20 and tank 30, respectively. Again, a pipe or other fluid output channeling means may be used instead of hose 28.

A foam concentrate reservoir 32 is connected to hose 28 between fluid pump 20 and tank 30 through an aspirator 33. Reservoir 32 injects a foam concentrate or detergent into output water hose 28 by any know means. Water and detergent enter tank 30 through a regulatory valve 34. Any known mixing chamber tank may be used, such as a Komax's Inline Motionless Mixer System.

In tank 30, air supplied by compressor 18 is combined under pressure with the water solution supplied by water pump 20, thereby forming foam. In the preferred embodiment, the air and water are injected into the tank at approximately 100 to 200 pounds per square inch, thereby providing sufficient pressure to drive the foam a safe and sufficient distance. It is important that the air and water are maintained at substantially the same pressure so that foam is generated instead of alternating air and water pockets.

Also connected to tank 30 is an output hose 44. The discharge of output hose 44 is controlled by an on/off valve 46. Hose 44 terminates at its end with nozzle 50. The hose, valve and nozzle, as well as the equivalent structure of a water ejecting cannon, may be referred to as foam discharge means. Varying the speed of engine 12 varies the rate of foam discharge.

INDUSTRIAL APPLICABILITY

The compressed air foam discharging apparatus is applicable in any situation requiring the discharge of foam. It is particularly applicable to the fire fighting and hazardous waste treatment fields. While the preferred embodiment of the invention has been disclosed it should be understood that certain variations and modifications may be made thereto without departing from the spirit of the invention.

I claim:

1. A compressed air foam discharging apparatus for fighting fires and for containing hazardous material spills, the apparatus comprising:

an engine having a first end;

a drive shaft driven by the engine where at least a portion of the drive shaft extends outwardly from the engine's first end;

a centrifugal fluid pump driven by and directly engaging the portion of the drive shaft extending outwardly from the engine's first end for pumping a first fluid through a first fluid channel;

a rotary screw air compressor operatively associated with and driven by the portion of the drive shaft extending outwardly from the engine's first end for directing a second fluid through a second fluid channel;

a connecting joining the first and second fluid channels allowing the first and second fluids to combine, where the connection includes an outlet; and a third fluid channel extending from the outlet of the connection.

2. The apparatus of claim 1 where the connection includes an air/water mixing tank.

3. The apparatus of claim 1 further comprising a foam concentrate reservoir operatively associated with the first fluid channel and an oil/air separator operatively associated with the second fluid channel.

4. The apparatus of claim 1 which further comprises an on/off valve connected to the third fluid channel.

5. A foam discharging apparatus for fighting fires and for containing hazardous material spills, the apparatus comprising:

an air/water mixing tank operable to mix air and water admitted thereto;

a hose having two ends with one end connected to the air/water mixing tank and the other end having a nozzle;

an engine having a drive shaft extending from one end thereof;

a centrifugal fluid pump having a drive shaft aligned with and directly engaging the drive shaft of the engine, the centrifugal fluid pump having an intake and an exhaust;

a water reservoir;

means connecting the water reservoir to the centrifugal fluid pump's intake;

a first fluid output channeling means connecting the centrifugal fluid pump's exhaust to the mixing tank, the first fluid output channeling means including an aspirator and a foam concentrate reservoir connected to the aspirator;

a rotary screw air compressor having a drive shaft;

a belt extending around both the engine's drive shaft and the rotary screw air compressor's drive shaft;

the rotary screw air compressor having an exhaust through which the compressed air flows; and second fluid output channeling means connecting the rotary screw air compressor's exhaust with the air/water mixing tank.

6. A compressed air foam discharging apparatus for fighting fires and for containing hazardous material spills, the apparatus comprising:

an engine having two ends;

a drive shaft driven by the engine where at least a portion of the drive shaft extends outwardly from both ends of the engine;

a centrifugal fluid pump directly engaging and driven by the portion of the drive shaft extending outwardly from one end of the engine for pumping a first fluid through a first fluid channel;

a rotary screw air compressor driven by the portion of the drive shaft extending outwardly from the other end of the engine for directing a second fluid through a second fluid channel;

a connection joining the first and second fluid channels allowing the first and second fluids to combine, where the connection includes an outlet; and a third fluid channel extending from the outlet of the connection.

* * * * *